US011735345B2

(12) United States Patent
Kanada et al.

(10) Patent No.: US 11,735,345 B2
(45) Date of Patent: Aug. 22, 2023

(54) METHOD FOR MANUFACTURING HALBACH MAGNET ARRAY

(71) Applicant: TOYOTA JIDOSHA KABUSHIKI KAISHA, Toyota (JP)

(72) Inventors: Keiu Kanada, Miyoshi (JP); Reimi Sakaguchi, Nisshin (JP); Masaaki Ito, Anjo (JP); Takuya Nomura, Kasugai (JP); Daisuke Ichigozaki, Toyota (JP); Motoki Hiraoka, Toyota (JP); Mitsutoshi Akita, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/804,466

(22) Filed: May 27, 2022

(65) Prior Publication Data

US 2022/0384083 A1 Dec. 1, 2022

(30) Foreign Application Priority Data

May 28, 2021 (JP) ..... 2021-089815

(51) Int. Cl.
*H01F 13/00* (2006.01)
*H01F 7/02* (2006.01)

(52) U.S. Cl.
CPC ..... *H01F 13/003* (2013.01); *H01F 7/021* (2013.01)

(58) Field of Classification Search
CPC ..... H01F 13/003; H01F 7/021; H01F 7/0278; H01F 7/0205; H01F 41/02
See application file for complete search history.

(56) References Cited

U.S. PATENT DOCUMENTS

2020/0282463 A1* 9/2020 Fujikawa ..... H01F 7/0205

FOREIGN PATENT DOCUMENTS

| | | | | |
|---|---|---|---|---|
| EP | 0877397 | A2 | * | 11/1998 |
| JP | 2013215021 | A | | 10/2013 |
| JP | 2015027208 | A | | 2/2015 |
| JP | 2018092988 | A | | 6/2018 |
| KR | 20100036526 | A | * | 4/2010 |

* cited by examiner

*Primary Examiner* — Mohamad A Musleh
(74) *Attorney, Agent, or Firm* — Dickinson Wright, PLLC

(57) ABSTRACT

The method for manufacturing the Halbach magnet array includes the steps of: (a) magnetizing at least two first magnetic material pieces in a direction parallel to a first direction, and (b) magnetizing at least one second magnetic material piece in a direction parallel to a second direction perpendicular to the first direction, in this order. In the step (a), the first magnetic material pieces and the second magnetic material piece are alternately arranged in the second direction with the first magnetic material pieces being each adhered to the adjacent second magnetic material piece, and the magnetization is performed under a condition in which a residual magnetization ratio r1 of the first magnetic material pieces is higher than a residual magnetization ratio r2 of the second magnetic material piece.

6 Claims, 7 Drawing Sheets

METHOD FOR MANUFACTURING HALBACH MAGNET ARRAY

CROSS REFERENCE TO RELATED APPLICATIONS

The present application claims priority from Japanese patent application JP 2021-089815 filed on May 28, 2021, the entire content of which is hereby incorporated by reference into this application.

BACKGROUND

Technical Field

The present disclosure relates to a method for manufacturing a Halbach magnet array.

Background Art

JP 2018-092988 A discloses a Halbach magnetic circuit that includes a plurality of permanent magnets having a plurality of magnetized regions in directions different from one another.

The Halbach magnetic circuit generally, as illustrated in FIG. 1, includes a plurality of permanent magnets arranged in one direction, and adjacent permanent magnets have magnetization directions forming a predetermined angle (for example, 90°). Such an arrangement causes one surface (a front surface) of the Halbach magnetic circuit to have a high surface magnetic flux (surface magnetic-flux density) and an opposite surface (a back surface) to have a low surface magnetic flux or ideally have zero surface magnetic flux.

SUMMARY

When a Halbach magnetic circuit is manufactured by gluing a plurality of magnetized magnets together, repulsion between the magnets makes it difficult to accurately control the positions of the magnets, thereby requiring a large external force. Therefore, such a manufacturing method is not appropriate for a mass-producing process. Meanwhile, when a Halbach magnetic circuit is manufactured by gluing a plurality of unmagnetized magnetic materials together and then magnetizing each of the magnetic materials in a predetermined direction and when a Halbach magnetic circuit is manufactured by forming a plurality of magnetized regions which are magnetized in different directions from one another in one permanent magnet as illustrated in JP 2018-092988 A, the Halbach magnetic circuit tends to have a small ratio of a magnetic-flux density of the front surface to that of the back surface.

Therefore, there is provided a method that allows easy manufacture of a Halbach magnet array having a large ratio of a magnetic-flux density of a front surface to that of a back surface.

According to one aspect of the present disclosure, there is provided a method for manufacturing a Halbach magnet array, the method comprising the steps, in this order, of:

(a) magnetizing at least two first magnetic material pieces in a direction parallel to a first direction, wherein the at least two first magnetic material pieces are alternately arranged with at least one second magnetic material piece in a second direction perpendicular to the first direction, wherein the at least two first magnetic material pieces are each adhered to the adjacent second magnetic material piece, wherein the at least two first magnetic material pieces each have an easy axis of magnetization parallel to the first direction, wherein the at least one second magnetic material piece each has an easy axis of magnetization parallel to the second direction, wherein the magnetizing is performed under a condition in which the at least two first magnetic material pieces and the at least one second magnetic material piece satisfy a formula (1) below:

$$r1>r2 \quad (1)$$

wherein r1 is a residual magnetization ratio of the at least two first magnetic material pieces, and is represented by a formula (2) below:

$$r1=Br1/Brs1 \quad (2)$$

wherein Br1 represents a residual magnetization of the at least two first magnetic material pieces when an external magnetic field parallel to the easy axis of the at least two first magnetic material pieces is applied to the at least two first magnetic material pieces, and Brs1 represents a saturated residual magnetization of the at least two first magnetic material pieces, and r2 is a residual magnetization ratio of the at least one second magnetic material piece, and is represented by a formula (3) below:

$$r2=Br2/Brs2 \quad (3)$$

wherein Br2 represents a residual magnetization of the at least one second magnetic material piece when an external magnetic field parallel to the easy axis of the at least one second magnetic material piece is applied to the at least one second magnetic material piece, and Brs2 represents a saturated residual magnetization of the at least one second magnetic material piece, and (b) magnetizing the at least one second magnetic material piece in a direction parallel to the second direction.

A manufacturing method according to the present disclosure allows easy manufacture of a Halbach magnet array having a large ratio of a magnetic-flux density of a front surface to that of a back surface.

DETAILED DESCRIPTION

Figure 1:
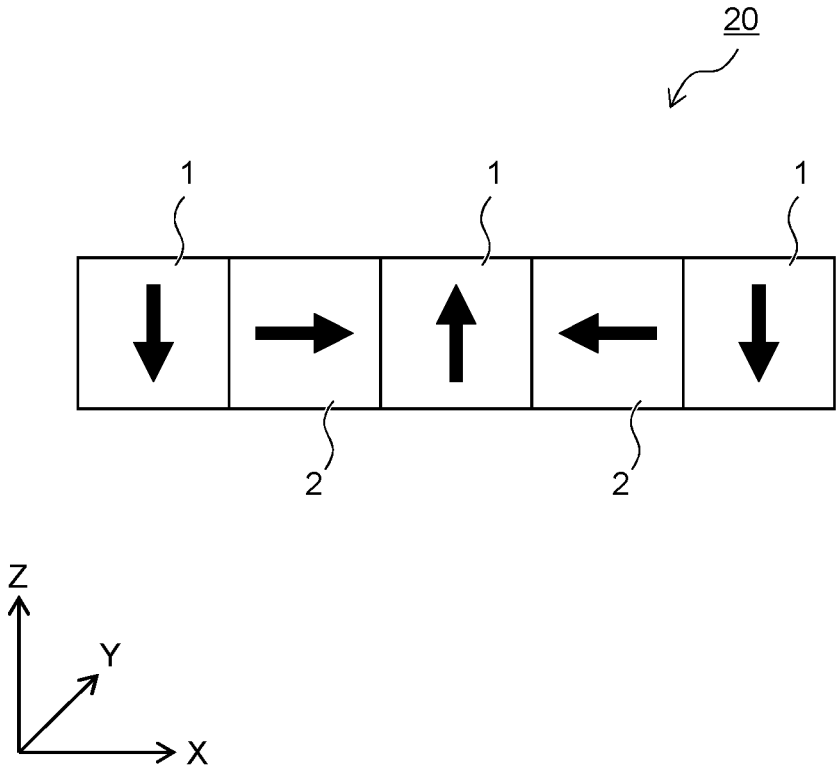
FIG. 1 is a drawing schematically illustrating an exemplary Halbach magnet array.

The following describes embodiments with reference to the drawings as necessary. The present disclosure is not limited to the following embodiments, and the design may be modified variously without departing from the spirits of the present invention described in the claims. Note that, in the drawings referred in the following description, the same reference numerals are attached to the same members or members having similar functions and the repeated descriptions are omitted in some cases. The drawings have dimensional proportions that may be different from the actual proportions for convenience of explanation, and parts of a member may be omitted from the drawing. In the application, a numerical range represented using a sign "-" includes respective numerical values written before and after the sign "-" as a lower limit value and an upper limit value.

Figure 2:
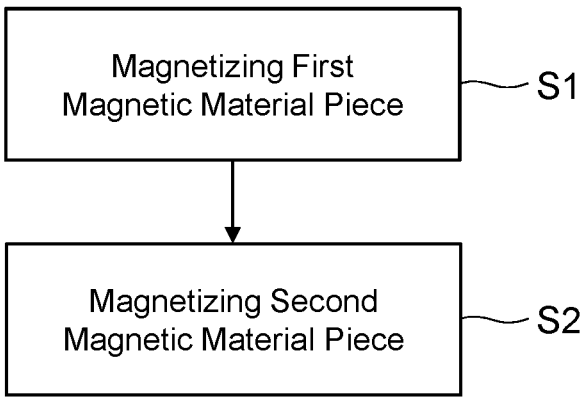
FIG. 2 is a flowchart of a manufacturing method according to an embodiment.

A method for manufacturing a Halbach magnet array includes, as illustrated in FIG. 2, a step (S1) of magnetizing first magnetic material pieces and a step (S2) of magnetizing second magnetic material pieces.

a) Magnetization of First Magnetic Material Piece

First, at least two unmagnetized first magnetic material pieces and at least one unmagnetized second magnetic material piece are prepared. The first magnetic material piece and the second magnetic material piece each include a permanent magnet material. Examples of the permanent magnet material includes an Nd—Fe—B-based magnet material, an Sm—Co-based magnet material, an Sm—Fe—N-based magnet material, a ferrite-based magnet material, and an Al—Ni—Co-based magnet material. The first magnetic material piece and the second magnetic material piece have a magnetic anisotropy. That is, the first magnetic material piece and the second magnetic material piece each have an easy axis and a hard axis of magnetization. The first magnetic material piece and the second magnetic material piece may have any shape, and, for example, may have an approximately rectangular shape. The first magnetic material piece and the second magnetic material piece can be manufactured by a generally known manufacturing method. As the first magnetic material piece and the second magnetic material piece, commercially available magnetic material pieces may be used.

Figure 3:
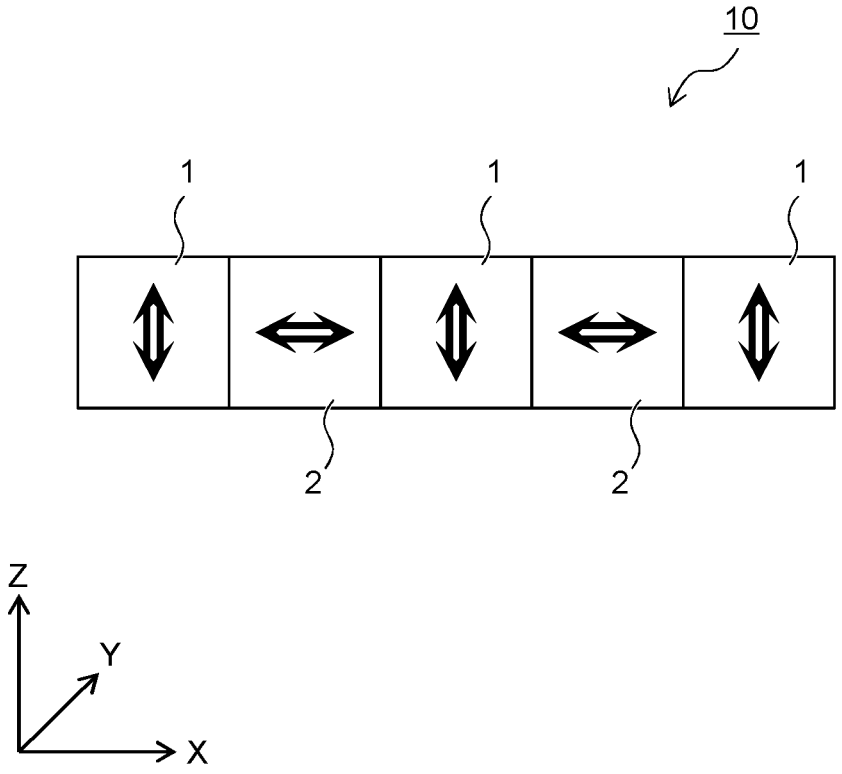
FIG. 3 is a drawing schematically illustrating an exemplary array provided for a step of magnetizing first magnetic material pieces.

As illustrated in FIG. 3, first magnetic material pieces 1 and second magnetic material pieces 2 are alternately arranged in a predetermined direction, and the adjacent first magnetic material pieces 1 and second magnetic material pieces 2 are adhered to each other to form an array 10. While in FIG. 3, the three first magnetic material pieces 1 and the two second magnetic material pieces 2 are alternately arranged, the at least two first magnetic material pieces may include more than three or less than three first magnetic material pieces, and the at least one second magnetic material piece may include more than two or less than two second magnetic material piece(s) as long as the first magnetic material pieces and the second magnetic material piece(s) can be alternately arranged. The first magnetic material piece 1 and the second magnetic material piece 2 may be adhered to each other with any adhesive agent.

In the array 10, the easy axis of each of the first magnetic material pieces 1 (represented by void arrows in FIG. 3) is parallel to a first direction (Z-direction in FIG. 3) and the easy axis of each of the second magnetic material pieces 2 (represented by void arrows in FIG. 3) is parallel to a second direction (X-direction in FIG. 3). Here, the first direction and the second direction are perpendicular to one another. The second direction is parallel to the arrangement direction of the first magnetic material pieces 1 and the second magnetic material pieces 2.

Next, the first magnetic material pieces 1 of the array 10 are magnetized in a direction parallel to the first direction. Magnetization directions of the first magnetic material pieces 1 adjacent to one another across one second magnetic material piece 2 are different by 180°.

The first magnetic material pieces 1 can be magnetized using any magnetizer. For example, the first magnetic material pieces 1 can be magnetized by placing the first magnetic material pieces 1 in a magnetic field (an external magnetic field) generated by a magnetizing yoke.

Conditions, such as an intensity of the external magnetic field that magnetizes the first magnetic material pieces 1 and temperatures of the first magnetic material pieces 1 and the second magnetic material pieces 2, are appropriately set according to magnetization characteristics of the first magnetic material pieces 1 and the second magnetic material pieces 2 such that a sufficiently large residual magnetization (remanence) is generated in each of the first magnetic material pieces 1 and a sufficiently small residual magnetization is generated in each of the second magnetic material pieces 2 or the residual magnetization of each of the second magnetic material pieces 2 becomes substantially zero.

In detail, the first magnetic material pieces 1 are magnetized under a condition in which the first magnetic material pieces 1 and the second magnetic material pieces 2 satisfy the following formula (1):

$$r1>r2 \quad (1).$$

In the formula (1), r1 represents a residual magnetization ratio of the first magnetic material piece 1, the residual magnetization ratio r1 represented by the following formula (2):

$$r1=Br1/Brs1 \quad (2).$$

In the formula (2), Br1 represents a residual magnetization when an external magnetic field parallel to the easy axis of the first magnetic material piece 1 is applied to the first magnetic material piece 1, and Brs1 represents a saturated residual magnetization of the first magnetic material piece 1. In the formula (1), r2 represents a residual magnetization ratio of the second magnetic material piece 2, the residual magnetization ratio r2 represented by the following formula (3):

$$r2=Br2/Brs2 \quad (3).$$

In the formula (3), Br2 represents a residual magnetization when an external magnetic field parallel to the easy axis of the second magnetic material piece 2 is applied to the second magnetic material piece 2, and Brs2 represents a saturated residual magnetization of the second magnetic material piece 2.

Exemplary conditions that satisfy the above-described formula (1) will be described later.

b) Magnetization of Second Magnetic Material Piece

Next, the second magnetic material pieces 2 of the array 10 are magnetized in a direction parallel to the second direction. Magnetization directions of the second magnetic material pieces 2 adjacent to one another across one first magnetic material piece 1 are different by 180°.

The second magnetic material pieces 2 can be magnetized using any magnetizer. For example, the second magnetic material pieces 2 can be magnetized by placing the second magnetic material pieces 2 in a magnetic field generated by a magnetizing yoke (an external magnetic field).

Conditions, such as an intensity of the external magnetic field that magnetizes the second magnetic material pieces 2 and temperatures of the second magnetic material pieces 2, may be appropriately set according to magnetization characteristics of the second magnetic material pieces 2 such that a sufficiently large residual magnetization is generated in each of the second magnetic material pieces 2.

Thus, a Halbach magnet array 20 as illustrated in FIG. 1 is manufactured.

The following describes illustrative conditions for satisfying the above-described formula (1).

In one embodiment, the first magnetic material piece 1 is easier to magnetize than the second magnetic material piece 2. In the application, "be easier to magnetize" means to require an external magnetic field with a smaller magnetic-flux density to magnetize an unmagnetized magnetic piece to a predetermined residual magnetization ratio under normal temperature condition. When the first magnetic material piece 1 is easier to magnetize than the second magnetic material piece 2, the above-described formula (1) can be fulfilled under a condition where the first magnetic material piece 1 and the second magnetic material piece 2 are at normal temperature. Therefore, in the embodiment, the first magnetic material pieces 1 may be magnetized under normal temperature.

In the embodiment, a difference between a magnetic-flux density B1 of the external magnetic field necessary for magnetizing the first magnetic material piece 1 to a residual magnetization ratio of 98% under normal temperature and a magnetic-flux density B2 of the external magnetic field necessary for magnetizing the second magnetic material piece 2 to a residual magnetization ratio of 98% under normal temperature may be larger than 0.2 T. That is, a formula: B2−B1>0.2 T may be satisfied. Furthermore, a formula: B2−B1>0.5 T may be satisfied, and, in particular, a formula: B2−B1>1 T may be satisfied.

In the embodiment, the residual magnetization ratio r1 of the first magnetic material piece 1 under the condition in which the first magnetic material piece 1 is magnetized may be, for example, 95% or more and 100% or less, and the residual magnetization ratio r2 of the second magnetic material piece 2 under the same condition may be, for example, 0% or more and less than 95%.

Generally, easiness of magnetizing a magnetic material piece depends on a proportion of the main phase of the magnetic material piece (for example, an Nd—Fe—B phase in the case of an Nd—Fe—B-based magnet material), a size of a crystal grain size, and the like. The first magnetic material piece 1 may have a proportion of the main phase higher than that of the second magnetic material piece 2 and/or may have an average crystal grain size larger than that of the second magnetic material piece 2. This allows the first magnetic material piece 1 to be magnetized more easily than the second magnetic material piece 2.

In the embodiment, the magnetic-flux density Ba of the external magnetic field used at the step of magnetizing the first magnetic material pieces 1 and the magnetic-flux density Bb of the external magnetic field used at the step of magnetizing the second magnetic material pieces 2 may satisfy Ba<Bb. When the second magnetic material pieces 2 are magnetized, since the first magnetic material pieces 1 are already magnetized, the second magnetic material pieces 2 can be sufficiently magnetized while reducing or suppressing effects of the external magnetic field for magnetizing the second magnetic material pieces 2 on the magnetization direction of the first magnetic material pieces 1.

In another embodiment, the first magnetic material pieces 1 are magnetized under a condition in which the first magnetic material pieces 1 each have a temperature higher than that of the second magnetic material pieces 2. Generally, the higher the temperature of the magnetic material piece is when magnetization is performed, the higher the residual magnetization ratio of the magnetic material piece becomes. Therefore, under the condition in which the first magnetic material pieces 1 each have a temperature higher than that of the second magnetic material pieces 2, the above-described formula (1) is satisfied. In the embodiment, the first magnetic material pieces 1 and the second magnetic material pieces 2 may be the same kind of magnetic material pieces. Note that, generally, a temperature dependence of the residual magnetization ratio of the magnetic material piece depends on a kind of a magnetic material included as the main component in the magnetic material piece, presence/absence of elemental substitution and a kind of a substitution element in the magnetic material, a structure (for example, a crystal grain size) of the magnetic material piece, and the like.

In the embodiment, the magnetization of the first magnetic material pieces 1 may be performed while heating the first magnetic material pieces 1, and may be performed while keeping the second magnetic material pieces 2 at normal temperature or cooling the second magnetic material pieces 2 to a temperature less than the normal temperature. In the embodiment, the magnetization of the second magnetic material pieces 2 may be performed while heating the second magnetic material pieces 2, and may be performed while keeping the first magnetic material pieces 1 at normal temperature or cooling the first magnetic material pieces 1 to a temperature less than the normal temperature. The first magnetic material pieces 1 and/or the second magnetic material pieces 2 can be heated using any heating means (for example, a hot plate resistance heater and a rubber heater). The first magnetic material pieces 1 and/or the second magnetic material pieces 2 may be heated and magnetized using a magnetizing yoke with a heater. The first magnetic material pieces 1 and/or the second magnetic material pieces 2 can be cooled using any cooling means (for example, a water cooling block).

In the embodiment, the residual magnetization ratio r1 of the first magnetic material piece 1 under the condition in which the first magnetic material piece 1 is magnetized may be, for example, 90% or more and 100% or less, and the residual magnetization ratio r2 of the second magnetic material piece 2 under the same condition may be, for example, 0% or more and less than 90% or 0% or more and 60% or less.

While the embodiment according to the present disclosure has been described above, the present disclosure is not limited to the above-described embodiment, and the various changes may be performed without departing from the spirits of the present invention described in the claims. Further embodiments can be provided by combining the above-described embodiment. For example, when first magnetic material pieces have different easiness of magnetization from that of second magnetic material pieces, the magnetization of the first magnetic material piece and/or the magnetization of the second magnetic material piece may be performed in a state where the first magnetic material piece and the second magnetic material piece have temperatures different from one another.

EXAMPLES

While the following specifically describes the present disclosure using examples, the present disclosure is not limited to these examples.

Example 1

Figure 4:
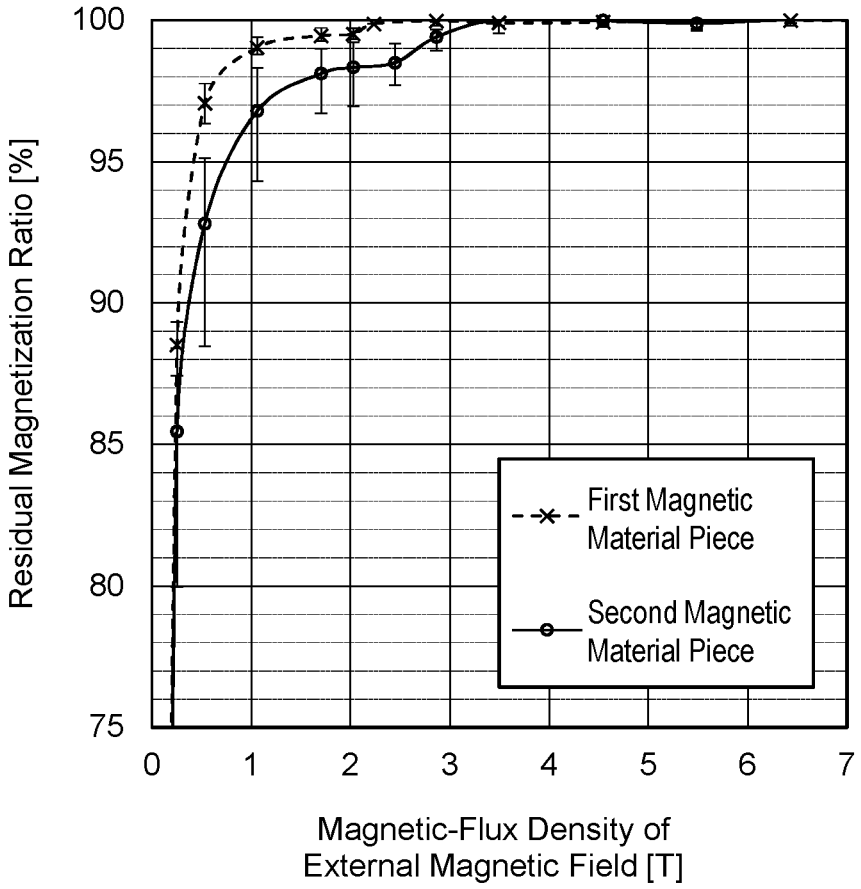
FIG. 4 is a graph illustrating magnetization characteristics of the first magnetic material pieces and second magnetic material pieces used in Example.

Three first magnetic material pieces (neodymium magnet sintered body) and two second magnetic material pieces (neodymium magnet sintered body) were prepared. Note that the first magnetic material piece and the second magnetic material piece both had magnetic anisotropy and had the magnetization characteristics illustrated in FIG. 4. FIG. 4 is a graph illustrating residual magnetization ratios (that is, ratios of the residual magnetizations to the saturated residual magnetizations) of the first magnetic material piece and the second magnetic material piece when external magnetic fields parallel to easy axes of the first magnetic material piece and the second magnetic material pieces were applied to the first magnetic material piece and the second magnetic material piece, respectively, with respect to the magnetic-flux densities of the external magnetic fields. The saturated residual magnetizations of the first magnetic material piece and the second magnetic material piece were obtained by measuring the residual magnetizations after magnetizing the first magnetic material piece and the second magnetic material piece by the external magnetic field with a magnetic-flux density of 7 T. The magnetic-flux density of the external magnetic field with which the residual magnetization ratio of the first magnetic material piece became 98% was approximately 0.6 T, the magnetic-flux density of the external magnetic field with which the residual magnetization ratio of the second magnetic material piece became 98% was approximately 1.6 T, and the difference between them was approximately 1 T.

The first magnetic material pieces and the second magnetic material pieces were alternately arranged in the second direction such that the easy axes of the first magnetic material pieces were parallel to the first direction and the easy axes of the second magnetic material pieces were parallel to the second direction perpendicular to the first direction, and the adjacent first magnetic material piece and second magnetic material piece were adhered to each other with an adhesive agent.

At normal temperature, the three first magnetic material pieces were magnetized by an external magnetic field parallel to the first direction and having a magnetic-flux density of approximately 0.5 T (Step a).

Next, at normal temperature, the two second magnetic material pieces were magnetized by an external magnetic field parallel to the second direction and having a magnetic-flux density of approximately 1.4 T (Step b).

As a result, a tested object having a Halbach array as illustrated in FIG. 1 was obtained.

Comparative Example 1

A tested object having a Halbach array was fabricated similarly to Example 1 except that the first magnetic material pieces were used instead of the second magnetic material pieces and the magnetic-flux density of the external magnetic field at Step b was 0.5 T.

Comparative Example 2

Five first magnetic material pieces were prepared and each of them was magnetized in the direction of its easy axis by an external magnetic field with a magnetic-flux density of 0.5 T. Next, the first magnetic material pieces were arranged in a row and glued together with an adhesive agent, and a tested object having a Halbach array as illustrated in FIG. 1 was fabricated.

Example 2

Figure 5:
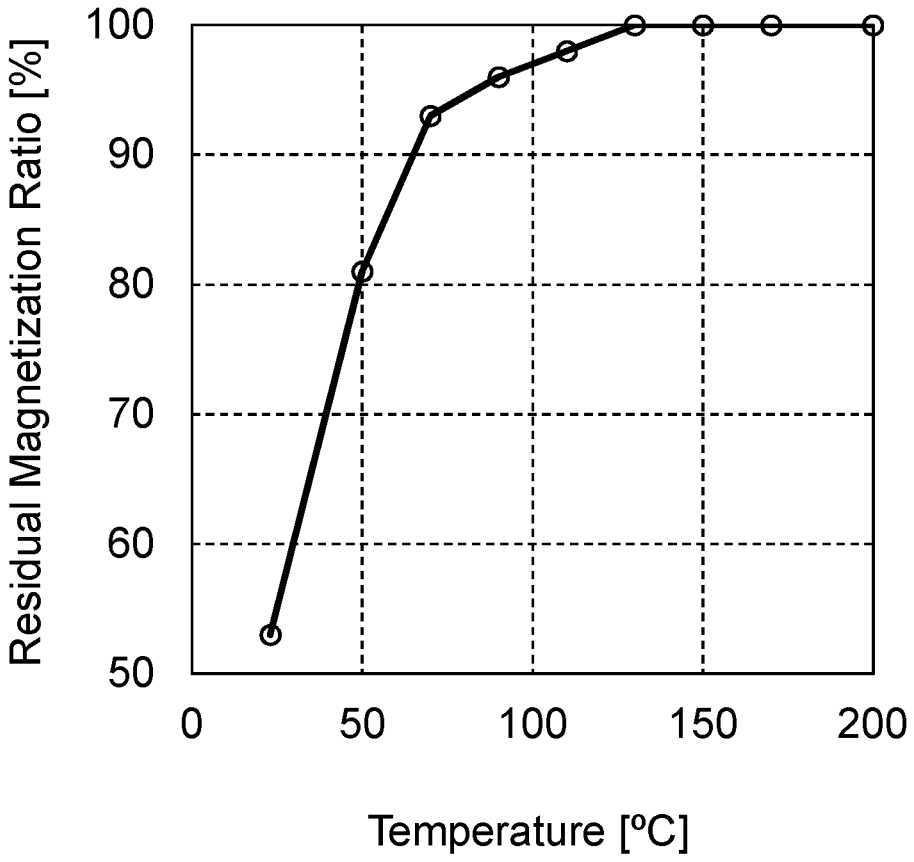
FIG. 5 is a graph illustrating magnetization characteristics of third magnetic material pieces used in Example.

Instead of the first magnetic material pieces and the second magnetic material pieces, third magnetic material pieces were used. The third magnetic material pieces were arranged similarly to Example 1 and glued together. The third magnetic material pieces had magnetization characteristics as illustrated in FIG. 5. FIG. 5 is a graph illustrating residual magnetization ratios (that is, ratios of the residual magnetization to the saturated residual magnetization) when a predetermined external magnetic field parallel to an easy axis of the third magnetic material piece was applied to the third magnetic material piece with respect to the temperature of the third magnetic material piece. The saturated residual magnetization was obtained by measuring the residual magnetization after magnetizing the third magnetic material piece by an external magnetic field with a magnetic-flux density of 7 T.

While heating three magnetic material pieces having the easy axes parallel to the first direction to 65° C. and cooling two magnetic material pieces having the easy axes parallel to the second direction to normal temperature or less, the three magnetic material pieces having the easy axes parallel to the first direction were magnetized by an external magnetic field parallel to the first direction and having a magnetic-flux density of approximately 0.2 T (Step a).

While heating the two magnetic material pieces having the easy axes parallel to the second direction to 65° C. or more and cooling the three magnetic material pieces having the easy axes parallel to the first direction to normal temperature or less, the two magnetic material pieces having the easy axes parallel to the second direction were magnetized by an external magnetic field parallel to the second direction and having a magnetic-flux density of approximately 0.2 T (Step b).

As a result, a tested object having a Halbach array as illustrated in FIG. 1 was obtained.

Comparative Example 3

A tested object having a Halbach array was fabricated similarly to Example 2 except that the heating and cooling of the magnetic material pieces were not performed at Steps a and b and the magnetic-flux density of the external magnetic field was 0.4 T.

Comparative Example 4

Five third magnetic material pieces were prepared and each of them was magnetized in a direction of its easy axis by an external magnetic field with a magnetic-flux density of 0.4 T. Next, the third magnetic material pieces were arranged and glued together with an adhesive agent, thereby fabricating a tested object having a Halbach array as illustrated in FIG. 1.

Evaluation

Magnetic fluxes on two surfaces, which are perpendicular to the first direction, of the respective tested objects were measured by a flux meter. Among the two surfaces, a surface with a large magnetic flux was defined as a front surface and a surface with a small magnetic flux was defined as a back surface, and ratios of the magnetic fluxes on the respective surfaces to sums of the magnetic fluxes of the front surfaces and the back surfaces were obtained. The results are shown in FIG. 6 and FIG. 7.

Figure 6:
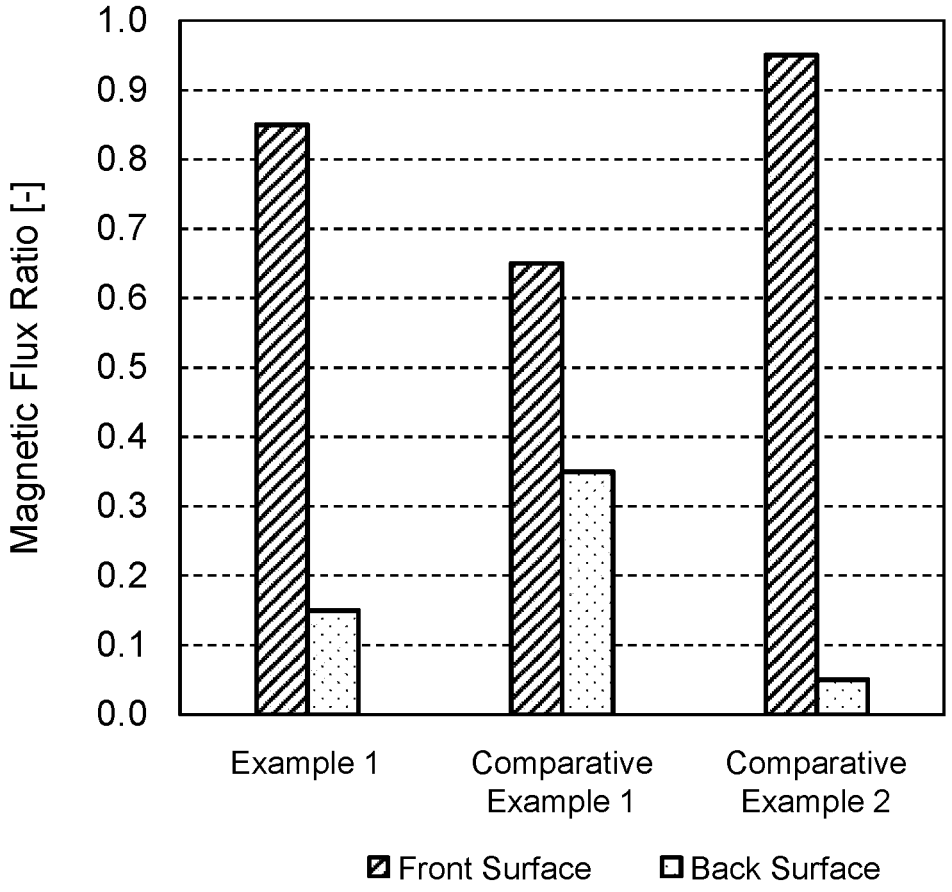
FIG. 6 is a drawing illustrating ratios of magnetic fluxes of front surfaces and ratios of magnetic fluxes of back surfaces to sums of the magnetic fluxes of the front surfaces and the back surfaces of tested objects in Example 1 and Comparative Examples 1 and 2.
Figure 7:
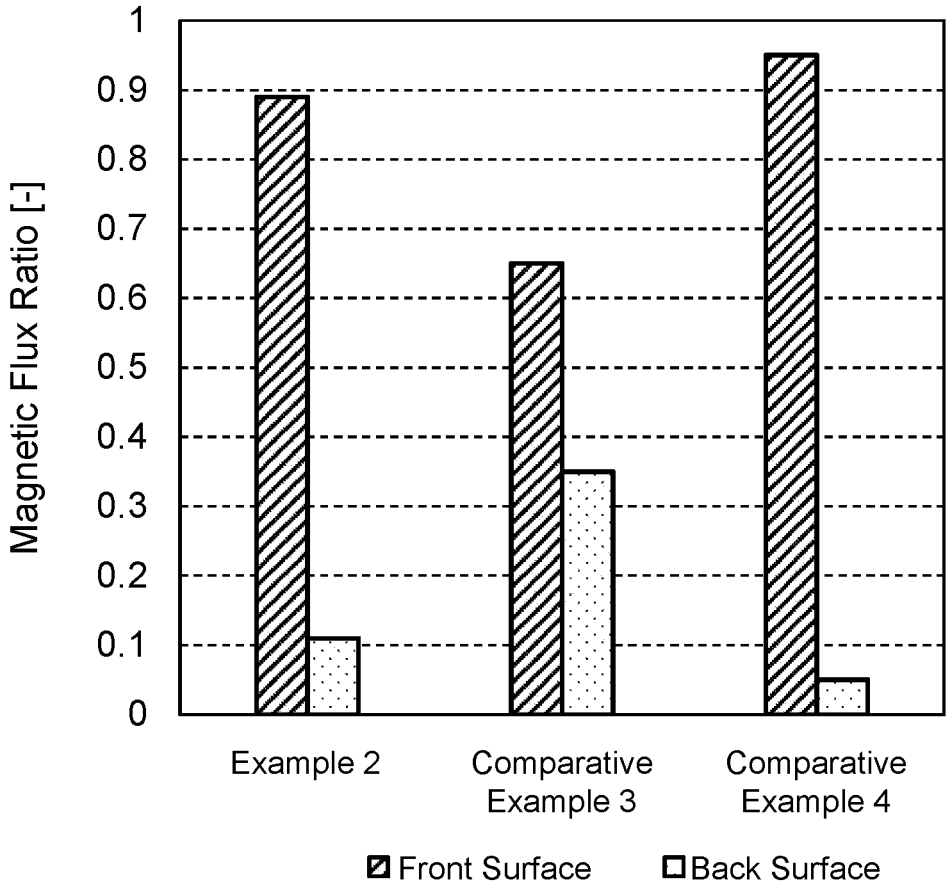
FIG. 7 is a drawing illustrating ratios of magnetic fluxes of front surfaces and ratios of magnetic fluxes of back surfaces to sums of the magnetic fluxes of the front surfaces and the back surfaces of tested objects in Example 2 and Comparative Examples 3 and 4.

As illustrated in FIG. 6, the tested object of Example 1 had a ratio of the magnetic flux on the front surface larger than that of the tested object of Comparative Example 1. As illustrated in FIG. 7, the tested object of Example 2 had a ratio of the magnetic flux on the front surface larger than that of the tested object of Comparative Example 3.

Note that the ratio of the magnetic fluxes on the front surfaces of the tested objects of Examples 1 and 2 were smaller than the ratios of the front surface magnetic fluxes of the tested objects of Comparative Examples 2 and 4, respectively, however, the tested objects of Comparative Examples 2 and 4 were fabricated by gluing the magnetized magnetic material pieces together and this fabrication method is not suitable for mass production.

What is claimed is:

1. A method for manufacturing a Halbach magnet array, the method comprising the steps, in this order, of:

(a) magnetizing at least two first magnetic material pieces in a direction parallel to a first direction, wherein the at least two first magnetic material pieces are alternately arranged with at least one second magnetic material piece in a second direction perpendicular to the first direction, wherein the at least two first magnetic material pieces are each adhered to the adjacent second magnetic material piece, wherein the at least two first magnetic material pieces each have an easy axis of magnetization parallel to the first direction, wherein the at least one second magnetic material piece each has an easy axis of magnetization parallel to the second direction, wherein the magnetizing is performed under a condition in which the at least two first magnetic material pieces and the at least one second magnetic material piece satisfy a formula (1) below:

$$r1>r2 \quad (1)$$

wherein r1 is a residual magnetization ratio of the at least two first magnetic material pieces, and is represented by a formula (2) below:

$$r1=Br1/Brs1 \quad (2)$$

wherein Br1 represents a residual magnetization of the at least two first magnetic material pieces when an external magnetic field parallel to the easy axis of the at least two first magnetic material pieces is applied to the at least two first magnetic material pieces, and Brs1 represents a saturated residual magnetization of the at least two first magnetic material pieces, and r2 is a residual magnetization ratio of the at least one second magnetic material piece, and is represented by a formula (3) below:

$$r2=Br2/Brs2 \quad (3)$$

wherein Br2 represents a residual magnetization of the at least one second magnetic material piece when an external magnetic field parallel to the easy axis of the at least one second magnetic material piece is applied to the at least one second magnetic material piece, and Brs2 represents a saturated residual magnetization of the at least one second magnetic material piece, and (b) magnetizing the at least one second magnetic material piece in a direction parallel to the second direction.

2. The method according to claim 1, wherein the at least two first magnetic material pieces and the at least one second magnetic material piece satisfy the formula (1) under normal temperature condition, wherein the step (a) includes magnetizing the at least two first magnetic material pieces by an external magnetic field with a magnetic-flux density Ba, wherein the step (b) includes magnetizing the at least one second magnetic material piece by an external magnetic field with a magnetic-flux density Bb, and wherein Ba<Bb.

3. The method according to claim 1, wherein the at least two first magnetic material pieces and the at least one second magnetic material piece satisfy a formula (4) below:

$$B2-B1>0.2T \quad (4)$$

wherein B1 represents a magnetic-flux density of an external magnetic field with which the residual magnetization ratio r1 of the at least two first magnetic material pieces becomes 98% at normal temperature, and B2 represents a magnetic-flux density of an external magnetic field with which the residual magnetization ratio r2 of the at least one second magnetic material piece becomes 98% at normal temperature.

4. The method according to claim 1, wherein the step (a) includes magnetizing the at least two first magnetic material pieces in a state where the at least two first magnetic material pieces have a temperature higher than a temperature of the at least one second magnetic material piece, and wherein the step (b) includes magnetizing the at least one second magnetic material piece in a state where the at least two first magnetic material pieces have a temperature lower than a temperature of the at least one second magnetic material piece.

5. The method according to claim 4, wherein the step (a) includes heating the at least two first magnetic material pieces, and wherein the step (b) includes heating the at least one second magnetic material piece.

6. The method according to claim 4, wherein the step (a) includes cooling the at least one second magnetic material piece, and wherein the step (b) includes cooling the at least two first magnetic material pieces.

* * * * *